US006599085B2

(12) United States Patent
Nadeau et al.

(10) Patent No.: US 6,599,085 B2
(45) Date of Patent: Jul. 29, 2003

(54) LOW TONE AXIAL FAN STRUCTURE

(75) Inventors: Sylvain Nadeau, London (CA); Konstantin Kurbatskii, London (CA)

(73) Assignee: Siemens Automotive, Inc., Mississauga (CA)

( * ) Notice: Subject to any disclaimer, the term of this patent is extended or adjusted under 35 U.S.C. 154(b) by 0 days.

(21) Appl. No.: 09/955,382

(22) Filed: Sep. 18, 2001

(65) Prior Publication Data

US 2003/0044283 A1 Mar. 6, 2003

Related U.S. Application Data

(60) Provisional application No. 60/315,997, filed on Aug. 31, 2001.

(51) Int. Cl.[7] ..... F04D 29/66

(52) U.S. Cl. ..... 415/119; 416/223; 416/193 R; 416/203

(58) Field of Search ..... 415/119; 416/223 R, 416/189, 191, 193 R, 175, 203

(56) References Cited

U.S. PATENT DOCUMENTS 1,232,795 A 7/1917 Hagen
4,358,245 A 11/1982 Gray
4,474,534 A 10/1984 Thode
4,569,632 A 2/1986 Gray, III
4,684,324 A 8/1987 Perosino
4,900,229 A 2/1990 Brackett et al.
4,915,588 A 4/1990 Brackett
5,000,660 A 3/1991 Van Houten et al.
5,326,225 A 7/1994 Gallivan et al.
5,454,695 A * 10/1995 Shah et al. ..... 416/203
5,577,888 A 11/1996 Capdevilla et al.
5,755,557 A * 5/1998 Alizadeh ..... 416/193 R
6,188,770 B1 2/2001 Okada
6,238,184 B1 5/2001 Giribaldi

* cited by examiner

*Primary Examiner*—Edward K. Look
*Assistant Examiner*—Dwayne J. White

(57) ABSTRACT

A low tone axial flow fan structure includes a hub 12; an inner fan 14 including a number of inner blades 16 attached to the hub and extending radially outwardly to a first circumferentially extending blade support structure 18; and an outer fan 20 including a number of outer blades 22 attached to the first circumferentially extending blade support structure 18 and extending radially outwardly to a second circumferentially extending blade support structure 20. The number of outer blades defines an outer fan blade passing order. The number of inner blades ensures creation of blade passing orders or multiple of said blade passing orders within one blade passing order of the outer fan blade passing order so as to provide masking of the outer fan blade passing order.

8 Claims, 4 Drawing Sheets

LOW TONE AXIAL FAN STRUCTURE

This application is based on U.S. Provisional Application No. 60/315,997 filing date Aug. 31, 2001 and claims the benefit thereof for priority purposes.

FIELD OF THE INVENTION

The invention relates to axial flow fans and more particularly to the reduction of axial fan blade passing frequency tone in engine cooling applications.

BACKGROUND OF THE INVENTION

The sound quality of axial fans is strongly influenced by the blade passing frequency (BPF) tone and harmonics generated by the blades. This BPF can be calculated from the blade passing order. The blade passing order corresponds to the number of blades multiplied by the speed of rotation in RPM divided by 60. Conventionally, these BPF tones can be minimized by skewing the blades (forward or backward), by using leaned blades and by using unequal blade spacing. However, the amount of skewing and leaning is always limited by the fan structural integrity and the unequal spacing is limited by the space available between the blades at the hub. As a consequence, the BPF tone and harmonics are still a major concern in today's fan sound quality.

Accordingly, there is a need to provide an axial flow fan that reduces the axial fan blade passing frequency (BPF) tone and harmonics for use in any engine cooling application requiring at least one axial fan.

SUMMARY OF THE INVENTION

An object of the invention is to fulfill the need referred to above. In accordance with the principles of the present invention, this objective is achieved by providing a low tone axial flow fan structure including a hub; an inner fan including a number of inner blades attached to the hub and extending radially outwardly to a first circumferentially extending blade support structure; and an outer fan including a number of outer blades attached to the first circumferentially extending blade support structure and extending radially outwardly to a second circumferentially extending blade support structure. The number of outer blades defines an outer fan blade passing order. The number of inner blades ensures creation of blade passing orders or multiple of said blade passing orders within one blade passing order of the outer fan blade passing order so as to provide masking of the outer fan blade passing order.

In accordance with another aspect of the invention, a low tone axial flow fan structure includes a hub; an inner fan including a number of inner blades attached to the hub and extending radially outwardly to a first circumferentially extending blade support structure; and an outer fan including outer blades. The number of outer blades is the same as the number of inner blades, with each outer blade being generally adjacent to an inner blade. The outer blades being attached to the first circumferentially extending blade support structure and extending radially outwardly to a second circumferentially extending blade support structure. A leading edge of each inner blade is shifted with respect to a leading edge of an adjacent outer blade.

Other objects, features and characteristics of the present invention, as well as the methods of operation and the functions of the related elements of the structure, the combination of parts and economics of manufacture will become more apparent upon-consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENT

Figure 1:
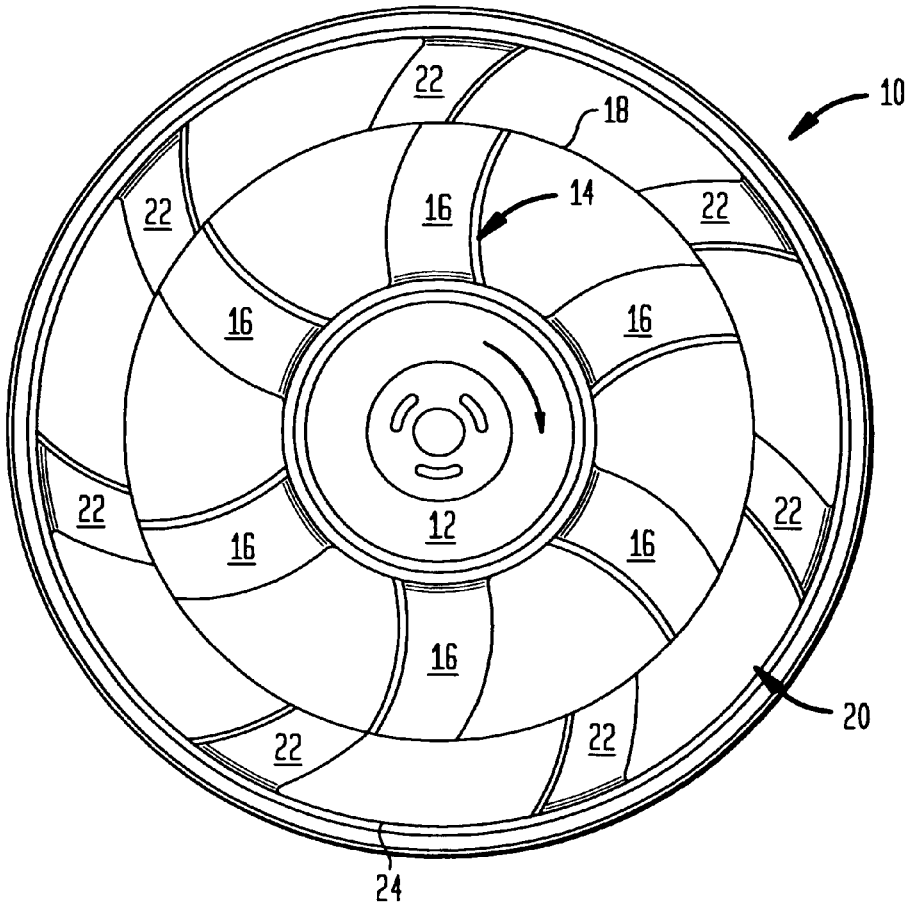
FIG. 1 is a front view of a low tone axial fan structure provided in accordance with the principles of a first embodiment of the invention.

With reference to FIG. 1, a low tone axial fan structure is shown, generally indicated at 10, in accordance with the principles of a first embodiment of the present invention.

The fan structure 10 comprises a hub 12 constructed and arranged to be mounted on a shaft of a motor (not shown). An inner fan, generally indicated at 14, includes a number of inner blades 16 attached to the hub 12 and extending radially outwardly to a first circumferentially extending blade support structure 18. An outer fan, generally indicated at 20, includes a number of outer blades 22 attached to the first blade support structure 18 and extending radially outwardly to a second circumferentially extending blade support structure 24. The number of outer blades 22 defines an outer fan blade passing order. The first and second circumferentially extending blade support structures are preferably in the form of ring members. In the illustrated embodiment, the inner fan includes six blades and the outer fan includes seven blades.

The number of inner blades 16 ensures creation of blade passing orders or multiple of blade passing orders within one blade passing order of the outer fan blade passing order so as to provide masking of the outer fan blade passing order.

Figure 2:
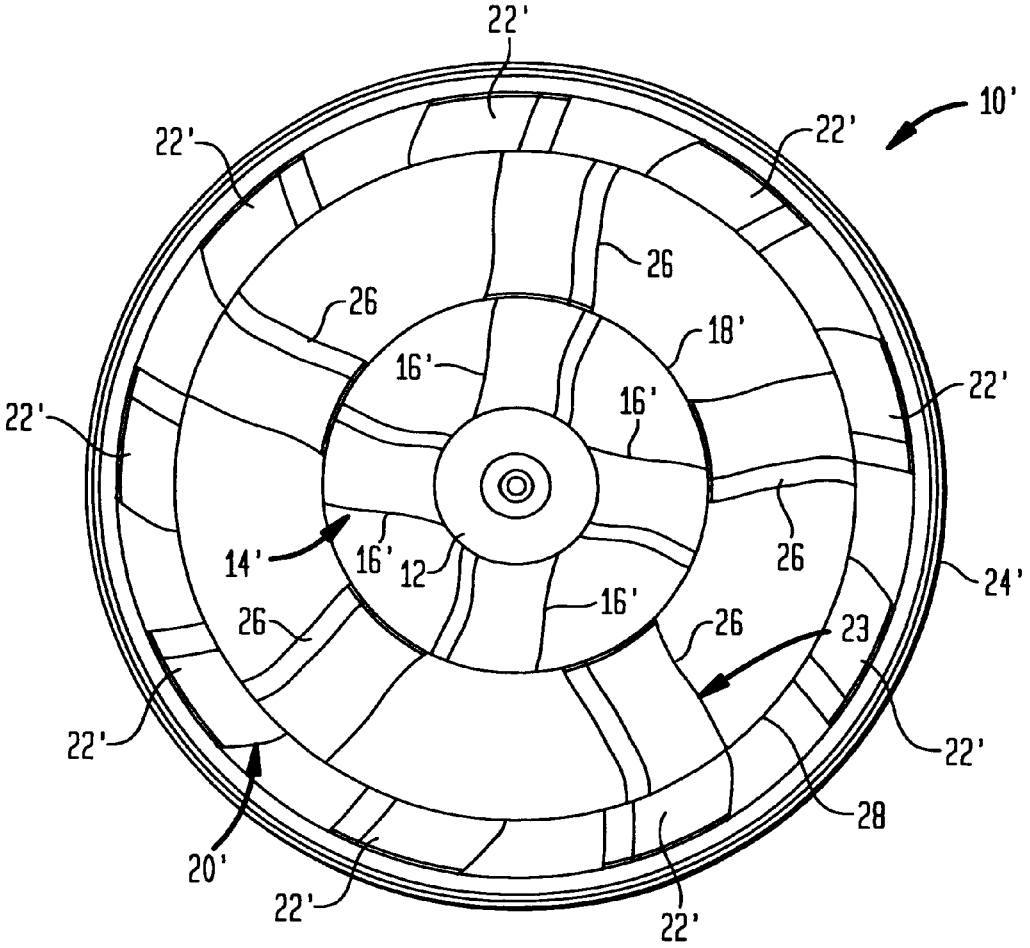
FIG. 2 is a front view of a second embodiment of a low tone axial fan structure of the invention.

FIG. 2 shows another embodiment of fan structure 10' of the invention including intermediate fan structure, generally indicated at 23, between the first and second circumferentially extending blade support members 18' and 24', respectively. The intermediate fan structure 23 includes a plurality of intermediate fan blades 26. In the illustrated embodiment, the intermediate fan structure 23 comprises one intermediate fan having blades 26 coupled to the first circumferentially extending blade support structure 18' and extending radially to an intermediate circumferentially extending blade support structure 28. The outer blades 22' of the outer fan 20' are coupled to the intermediate circumferentially extending blade support structure 28. The inner fan 14' has four blades 16' to create a $4^{th}$ blade passing order and multiples of the $4^{th}$ blade passing order. The intermediate fan 23 has five blades to create a $5^{th}$ blade passing order and multiples of the $5^{th}$ order, outer fan 20' has nine blades creating a $9^{th}$ outer blade passing order, whereby $8^{th}$ and $10^{th}$ blade passing orders generated by the inner and intermediate fans provide masking of the $9^{th}$ outer blade passing order. Another example of blade number arrangement for a fan structure composed of an inner, an intermediate and an outer fan is to have 8 blades on the inner fan, 3 blades on the intermediate fan and 7 blades on the outer fan.

Figure 3:
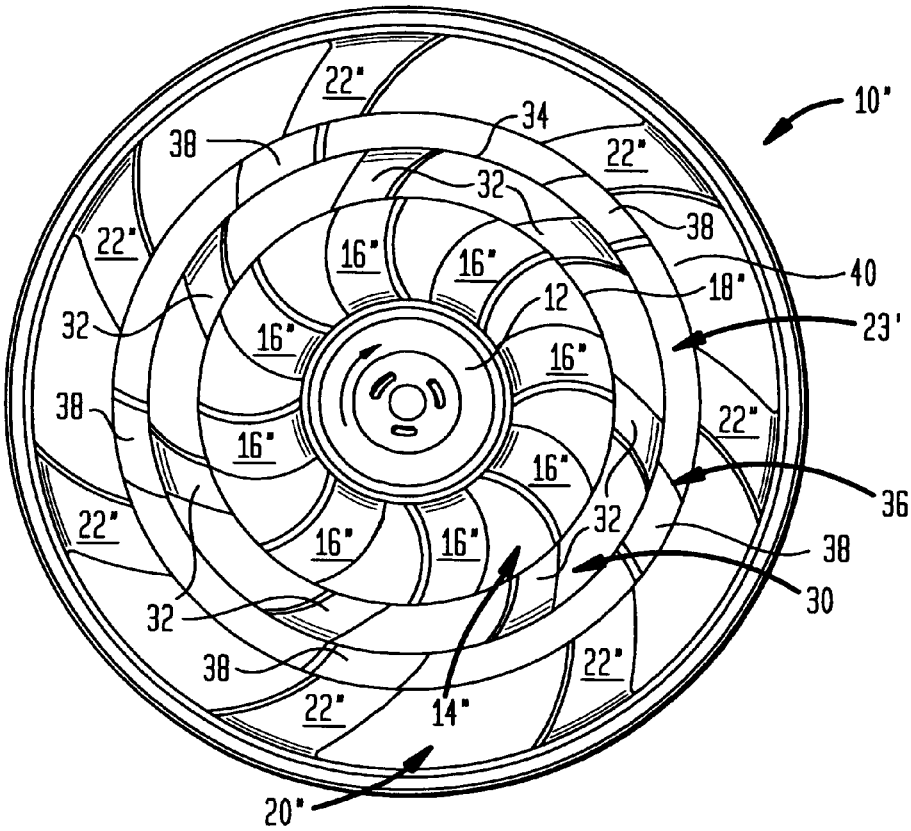
FIG. 3 is a front view of a third embodiment of a low tone axial fan structure of the invention.

In accordance with another embodiment of fan structure 10" of the invention as shown in FIG. 3, the intermediate fan structure 23' comprises at least two intermediate fans with a first intermediate fan, generally indicated at 30, having blades 32 coupled to the first circumferentially extending blade support structure 18" and extending radially to a first intermediate circumferentially extending blade support structure 34. A second intermediate fan, generally indicated at 36, has blades 38 coupled to the first intermediate circumferentially extending blade support structure 34 and extending radially to a second intermediate radially extending blade support structure 40. The outer blades 22" of the outer fan 20" are coupled to the second intermediate circumferentially extending blade support structure 40. It can be appreciated that any number of intermediate fans can be provided in accordance with the invention. The inner fan 14" includes eight inner blades 16".

Thus, the number of blades of the inner fan and each intermediate fan is selected in order to mask the outer fan blade passing order (OFBPO). The number of blades of the inner and intermediate fans are selected to create blade passing orders or multiple of these orders at +and/or −1 the OFBPO.

An example for a fan structure composed of five fans (not shown) would be 5, 9, 6, 8 and 7 blades going from the innermost fan to the outermost fan. This blade arrangement strategy can also be used in combination with more traditional approaches to minimize the BPF like unequal spacing, leaned blades and forwardly or backwardly skewed blades. It is also recommended to use a highly loaded fan with the previously described blade arrangement strategy in order to minimize the speed of rotation and hence the $\Delta f$ between the outer fan BPF and the inner fans masking frequencies.

Figure 4:
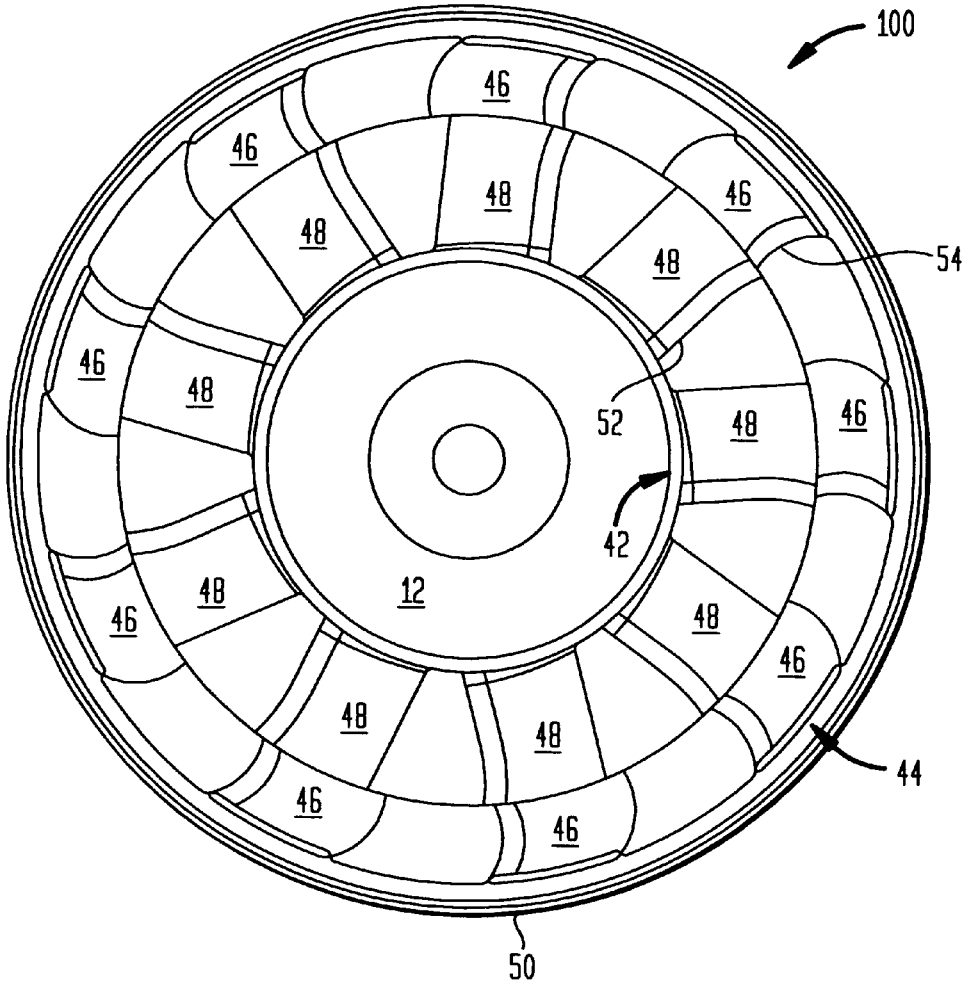
FIG. 4 is a front view of a fourth embodiment of a low tone axial fan structure of the invention.

Another aspect of fan structure 100 of the present invention is shown in FIG. 4. In this embodiment, the same number of blades are used on the inner fan 42 and on the outer fan 44, with each outer blade 46 being generally adjacent to an inner blade 48. A small angle shift is introduced between the inner and outer fans but the angle is small enough so that at it is possible to pass a curve through the adjacent inner and outer blades from the hub 12 to the tip band 50. In addition, the leading edges 52 of each inner blade 48 is shifted with respect to the leading edge 54 of an adjacent outer blade 48. This arrangement provides more structural resistance than misaligned blades while introducing a significant phase shift that will tend to mask the blade passing frequency. It is also possible to use an unequal blade spacing, leaned or skewed blades with this arrangement as long as it is possible to pass a curve through all the blades The invention can also be used with fans composed of 3 or more fans.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A low tone axial flow fan structure comprising:

a hub, an inner fan including a number of inner blades attached to the hub and extending radially outwardly to a first circumferentially extending blade support structure, the number of inner blades defining an inner fan blade passing order or defining multiples of the inner fan blade passing order, an outer fan including a number of outer blades attached to the first circumferentially extending blade support structure and extending radially outwardly to a second circumferentially extending blade support structure, the number of outer blades defining an outer fan blade passing order, wherein the inner fan blade passing order, or multiples thereof, is within one blade passing order of the outer fan blade passing order so as to provide masking of the outer fan blade passing order.

2. The low tone axial flow fan structure of claim 1, wherein the number of inner blades is six and the number of outer blades is seven.

3. The low tone axial flow fan structure of claim 1, wherein each first and second circumferentially extending blade support structure is a ring member.

4. A low tone axial flow fan structure comprising:

a hub, an inner fan including a plurality of inner blades attached to the hub and extending radially outwardly to a first circumferentially extending blade support structure, the number of inner blades defining an inner fan blade passing order or defining multiples of the inner fan blade passing order, an outer fan including a plurality of outer blades extending radially outwardly to a second circumferentially extending blade support structure, the number of second blades defining an outer fan blade passing order, and intermediate fan structure between the first and second circumferentially extending blade support members, the intermediate fan structure including a plurality of intermediate fan blades, the number of intermediate fan blades defining an intermediate fan blade passing order or defining multiples of the intermediate fan blade passing order, wherein both the inner fan blade passing order or multiples thereof and the intermediate fan blade passing order or multiples thereof are within one blade passing order of the outer fan blade passing order so as to provide masking of the outer fan blade passing order.

5. The low tone axial flow fan structure of claim 4, wherein the intermediate fan structure comprises one intermediate fan having blades coupled to the first circumferentially extending blade support structure and extending radially to an intermediate circumferentially extending blade support structure, the outer blades being coupled to the intermediate circumferentially extending blade support structure.

6. The low tone axial flow fan structure of claim 5, wherein the inner fan has four blades to create a $4^{th}$ blade passing order and multiples of the $4^{th}$ blade passing order, the intermediate fan structure has five blades to create a $5^{th}$ blade passing order and multiples of the $5^{th}$ order, outer fan has nine blades creating a $9^{th}$ outer blade passing order, whereby $8^{th}$ and $10^{th}$ blade passing orders generated by the inner and intermediate fans provide masking of the $9^{th}$ outer blade passing order.

7. The low tone axial flow fan structure of claim 4, wherein the intermediate fan structure comprises at least two intermediate fan with a first intermediate fan having blades coupled to the first circumferentially extending blade support structure and extending radially to a first intermediate circumferentially extending blade support structure, and a second intermediate fan having blades coupled to the first intermediate circumferentially extending blade support structure and extending radially to a second intermediate radially extending blade support structure, the outer blades being coupled to the second intermediate circumferentially extending blade support structure.

8. A low tone axial flow fan structure comprising:

a hub, an inner fan including a number of inner blades attached to the hub and extending radially outwardly to a first circumferentially extending blade support structure, an outer fan including outer blades, the number of outer blades being the same as the number of inner blades, with each outer blade being generally adjacent to an inner blade, the outer blades being attached to the first circumferentially extending blade support structure and extending radially outwardly to a second circumferentially extending blade support structure, wherein a leading edge of each inner blade is shifted with respect to a leading edge of an adjacent outer blade.

* * * * *